US007458638B1

(12) United States Patent
Frank

(10) Patent No.: US 7,458,638 B1
(45) Date of Patent: Dec. 2, 2008

(54) LIFT CHAIR SYSTEM

(76) Inventor: Donald R. Frank, 5516 SW. First La., Ocala, FL (US) 34474

( * ) Notice: Subject to any disclaimer, the term of this patent is extended or adjusted under 35 U.S.C. 154(b) by 0 days.

(21) Appl. No.: 11/983,000

(22) Filed: Nov. 6, 2007

(51) Int. Cl.
*A47C 3/24* (2006.01)

(52) U.S. Cl. ..... 297/344.14; 297/162; 297/344.2

(58) Field of Classification Search ..... 297/155, 297/162, 173, 344.14, 344.17, 344.18, 344.2, 297/411.36; 248/161, 188.5, 405, 420
See application file for complete search history.

(56) References Cited

U.S. PATENT DOCUMENTS 1,843,564 A 2/1932 Koken
3,377,966 A * 4/1968 Bates et al. ..... 297/344.18
3,642,320 A * 2/1972 Ward ..... 297/344.18
3,960,406 A * 6/1976 Buker ..... 297/344.18
4,043,277 A * 8/1977 Wallace ..... 248/188.5
4,408,743 A * 10/1983 DeWitt et al. ..... 297/344.18
4,852,940 A * 8/1989 Kanigowski ..... 297/145
4,928,916 A * 5/1990 Molloy ..... 249/354.1
5,385,323 A * 1/1995 Garelick ..... 297/344.18
5,407,249 A * 4/1995 Bonutti ..... 297/411.35
5,487,590 A * 1/1996 Haynes ..... 297/344.14
5,509,719 A * 4/1996 Cone, II ..... 297/344.14
6,443,406 B1 * 9/2002 Frank ..... 248/125.8
6,957,859 B1 10/2005 Patus
7,249,386 B2 7/2007 Terzo

* cited by examiner

*Primary Examiner*—Peter R. Brown

(57) ABSTRACT

A chair has an essentially horizontal seat. An adjustable positioning assembly between a horizontal upper brace supporting the chair and a lower brace allows for varying the height between the chair and a recipient surface.

3 Claims, 4 Drawing Sheets

FIG 1
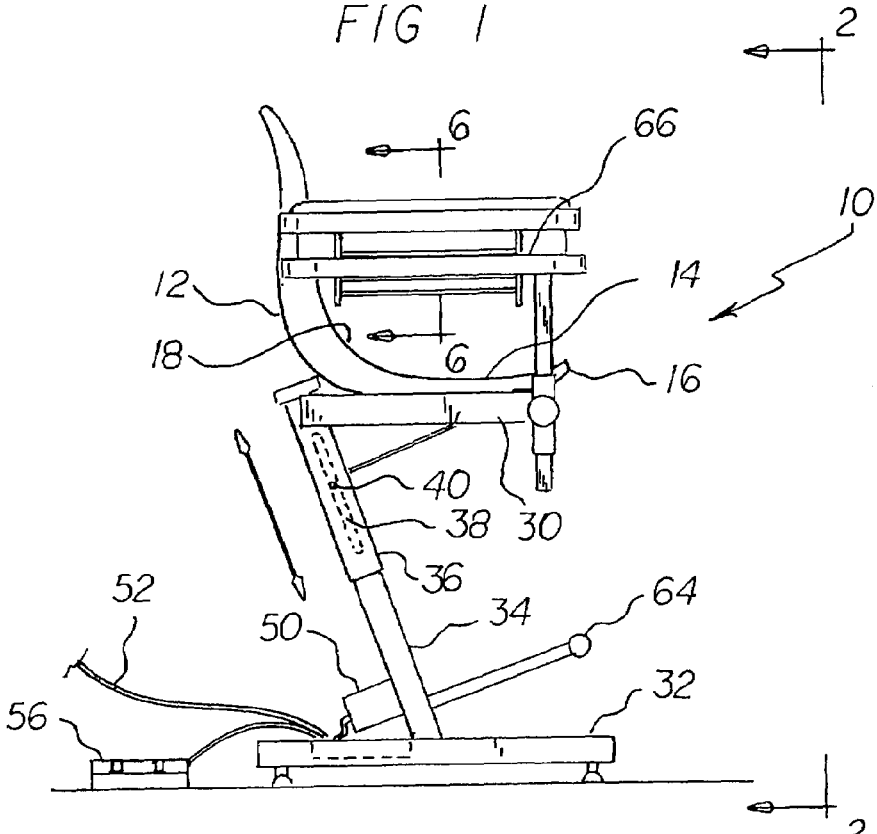
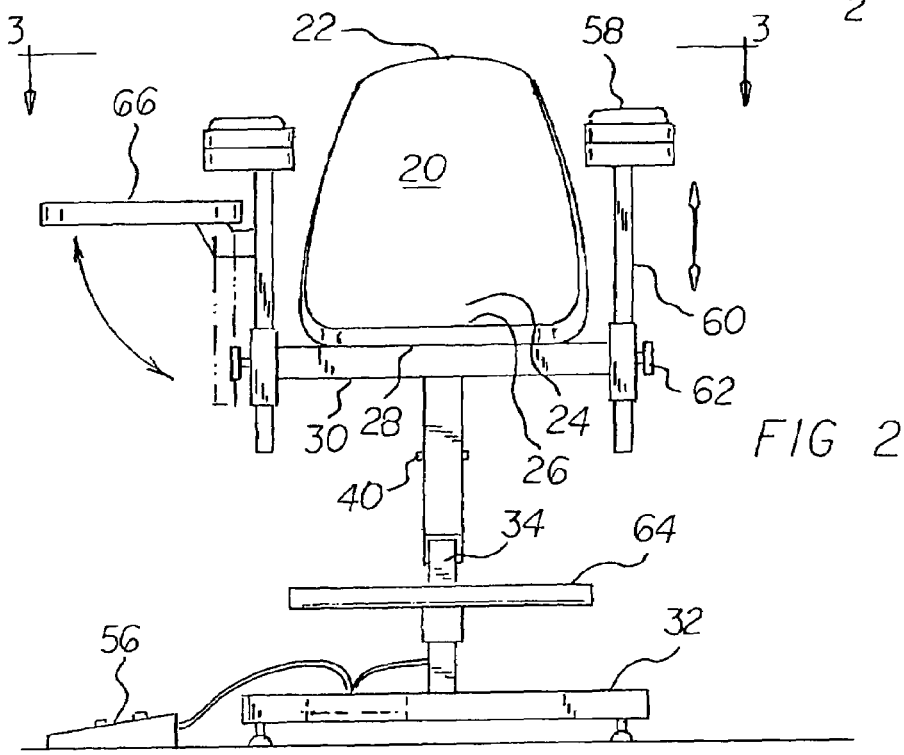
FIG 2

FIG 3
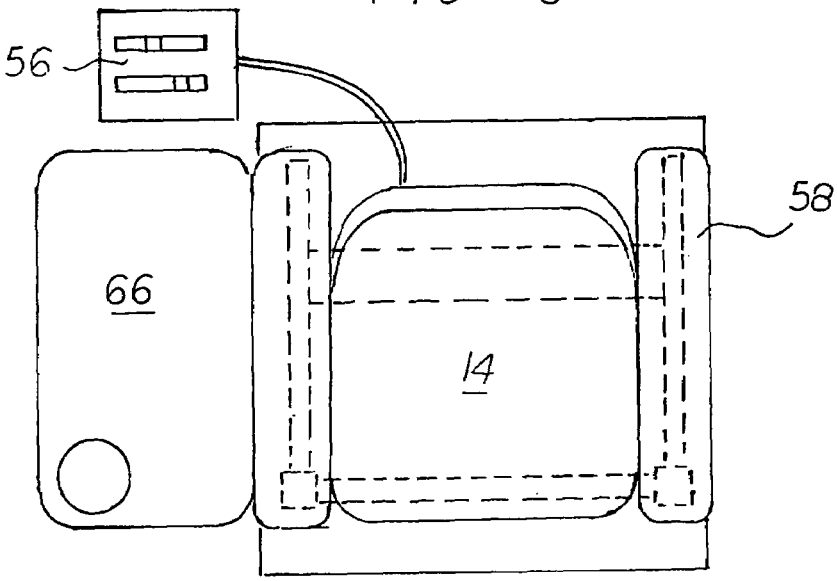
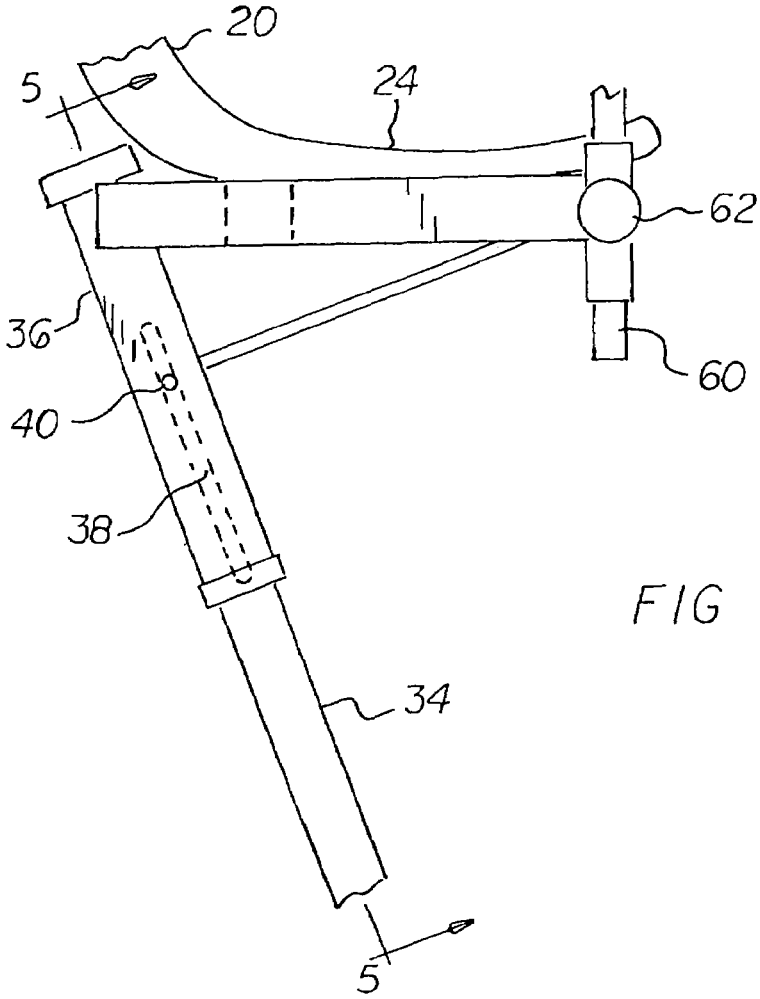
FIG 4

FIG 6
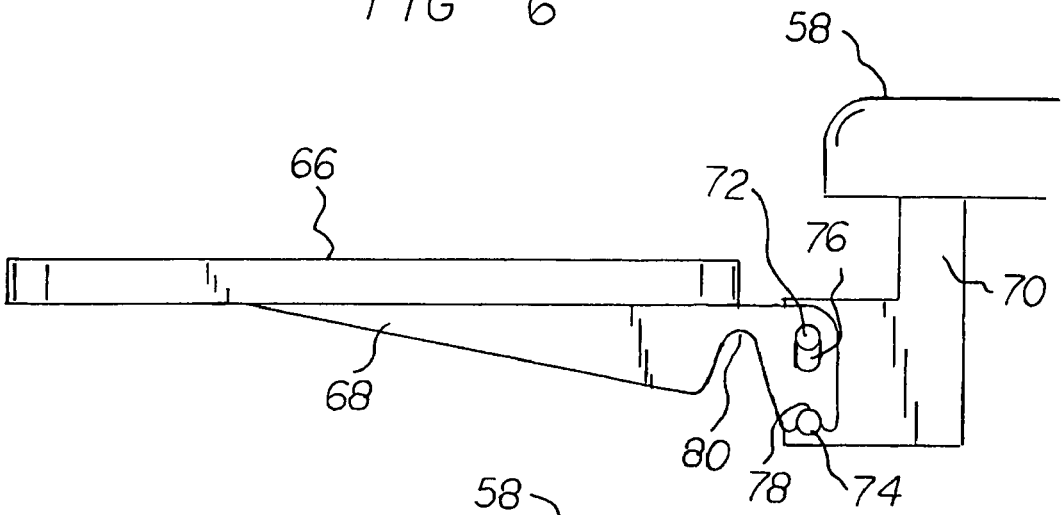
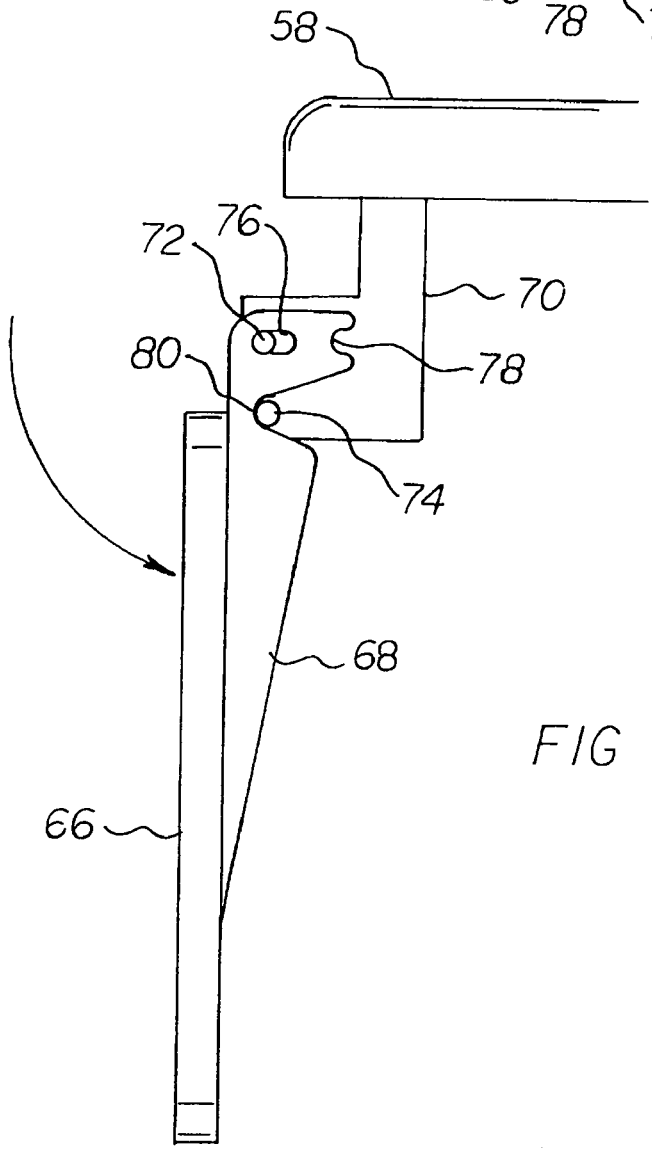
FIG 7

LIFT CHAIR SYSTEM

BACKGROUND OF THE INVENTION

1. Field of the Invention

The present invention relates to a lift chair system and more particularly pertains to raising and lowering of a chair in a safe, convenient and economical manner.

2. Description of the Prior Art

The use of chairs of known designs and configurations is known in the prior art. More specifically, chairs of known designs and configurations previously devised and utilized for the purpose of adjusting chairs through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,843,564 issued Feb. 2, 1932 to Koken relates to a Barber Chair. U.S. Pat. No. 6,957,859 issued Oct. 25, 2005 to Patus relates to a Chair for a person Lift. Lastly, U.S. Pat. No. 7,249,386 issued Jul. 31, 2007 to Terzo relates to a Portable Pool Lift for Disabled Persons.

While these devices fulfill their respective, particular objectives and requirements, the aforementioned patents do not describe a lift chair system that allows for raising and lowering of a chair in a safe, convenient and economical manner.

In this respect, the lift chair system according to the present invention substantially departs from the conventional concepts and designs of the prior art, and in doing so provides an apparatus primarily developed for the purpose of raising and lowering of a chair in a safe, convenient and economical manner.

Therefore, it can be appreciated that there exists a continuing need for a new and improved lift chair system which can be used for raising and lowering of a chair in a safe, convenient and economical manner. In this regard, the present invention substantially fulfills this need.

SUMMARY OF THE INVENTION

In view of the foregoing disadvantages inherent in the known types of chairs of known designs and configurations now present in the prior art, the present invention provides an improved lift chair system. As such, the general purpose of the present invention, which will be described subsequently in greater detail, is to provide a new and improved lift chair system and method which has all the advantages of the prior art and none of the disadvantages.

To attain this, the present invention essentially comprises a lift chair system. First provided is a chair. The chair has an essentially horizontal seat. The seat has a front edge. The seat has a rear edge. The chair also has an essentially vertical back. The back has an upper edge. The back has a lower edge. The lower edge of the back is coupled to the rear edge of the seat. The seat has a horizontal upper surface. The upper surface receives a user. The seat also has a horizontal lower surface.

A horizontal upper brace is provided. The upper brace has parallel longitudinally spaced support rails. The upper brace has parallel laterally spaced side rails. The upper brace has an upper surface. The upper surface of the upper brace receives the lower surface of the seat.

Provided next is a horizontal lower brace. The lower brace has parallel longitudinally spaced support rails. The lower brace has parallel laterally spaced side rails. The lower brace has a lower surface. The lower surface of the lower brace is positionable on a horizontal recipient surface.

An adjustable positioning assembly is provided. The positioning assembly is adapted to vary the height between the upper and lower braces. In this manner the height may be varied between the chair and a recipient surface. The positioning assembly includes a lower tube. The lower tube has an upper end. The lower tube has a lower end. The lower end of the lower tube is attached to the lower brace centrally. The lower end of the lower tube has a small square cross sectional configuration. The positioning assembly also includes an upper tube. The upper tube has a lower end. The lower end of the upper tube is has aligned apertures. The upper tube has an upper end. The upper end of the upper tube is attached to the upper brace rearwardly. The upper end of the upper tube has large square cross sectional configuration. The upper and lower braces and the tubes form a Z-shaped configuration. The tubes are provided at an angle of about 30 degrees from the vertical. The upper end of the lower tube is slidably received in the lower end of the upper tube. The positioning assembly includes aligned axial slots. The slots are provided in the lower tube. The positioning assembly includes aligned radial fingers. The radial fingers are provided interior of the upper tube. The radial fingers extend through the slots and aligned apertures, the radial fingers are located adjacent to the axial center of the upper tube. In this manner the lower portion of the upper tube will hide the slots when the chair and upper tube are in the upper orientation. Further in this manner the upper portion of the tube will hide the slots when the chair and upper tube are in the lower orientation.

Provided next is a drive assembly. The drive assembly raises and lowers the upper tube, upper brace and chair with respect to the lower tube, lower brace and recipient surface. The drive assembly includes a rotatable drive screw. The rotatable drive screw is provided interior of the tubes. The drive assembly has an upper bolt. The upper bolt is secured interior of the lower tube adjacent to its upper end. The drive assembly has a lower bolt. The interior of the lower tube supports the fingers. The upper and lower bolts are threadedly received in the drive screw. In this manner rotation of the drive screw will raise and lower the bolts, fingers, upper tube, upper brace and chair. The fingers have exterior ends. The exterior ends of the fingers have annular components. The annular components contact the upper tube. The annular components further limit the upward movement of the upper tube. The drive assembly also includes a motor. The motor has a line. The line couples the motor to a source of electrical potential. The motor has a driver. The driver couples the motor and the drive screw. The motor has a foot actuated controller. The foot actuated controller activates the motor and drive screw. In this manner the chair is raised and lowered.

Further provided are arm rests. The arm rests are secured at laterally spaced locations with respect to the chair. The arm rests have vertical supports. The vertical supports depend from the arm rests. The arm rests also have clamps. The clamps are secured at laterally spaced locations with respect to the upper brace. In this manner the vertical supports and arm rests are secured at comfortable elevations for a user. A foot rest is provided. The foot rest extends forwardly from the lower tube. In this manner comfort is provided for a user.

Provided last is a table. The table is adjustably secured to one side of the chair. The table includes depending pivotal brackets. The table includes fixed brackets. The fixed brackets depend from one arm rest. The fixed brackets have an upper rod. The fixed brackets also have a parallel lower rod. The pivotal brackets have elongated holes. The elongated holes pivotally receive the upper rod. The pivotal brackets have a lower notch. The lower notch receives the lower rod when the table is in the operative raised orientation. Note FIG. 6. The pivotal brackets have a laterally spaced upper notch. The upper notch receives the lower rod when the table is in the inoperative lowered orientation. Note FIG. 7.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lift chair system which has all of the advantages of the prior art chairs of known designs and configurations and none of the disadvantages.

It is another object of the present invention to provide a new and improved lift chair system which may be easily and efficiently manufactured and marketed.

It is further object of the present invention to provide a new and improved lift chair system which is of durable and reliable constructions.

An even further object of the present invention is to provide a new and improved lift chair system which is susceptible of a low cost of manufacture with regard to both materials and labor, and which accordingly is then susceptible of low prices of sale to the consuming public, thereby making such lift chair system economically available to the buying public.

Even still another object of the present invention is to provide a lift chair system for raising and lowering of a chair in a safe, convenient and economical manner.

Lastly, it is an object of the present invention to provide a new and improved lift chair system having a chair with an essentially horizontal seat and an adjustable positioning assembly between a horizontal upper brace supporting the chair and a lower brace allowing for varying the height between the chair and a recipient surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a lift chair system constructed in accordance with the principles of the present invention.

FIG. 2 is a front elevational view of the lift chair system taken along line 2-2 of FIG. 1.

FIG. 3 is a plan view of the system taken along line 3-3 of FIG. 2.

FIG. 4 is an enlarged side elevational view of the central section of the system.

FIG. 6 is a front elevational view of the table in the operative elevated orientation.

FIG. 7 is a front elevational view of the table in the inoperative lowered orientation.

The same reference numerals refer to the same parts throughout the various Figures.

DESCRIPTION OF THE PREFERRED EMBODIMENT

Figure 5:
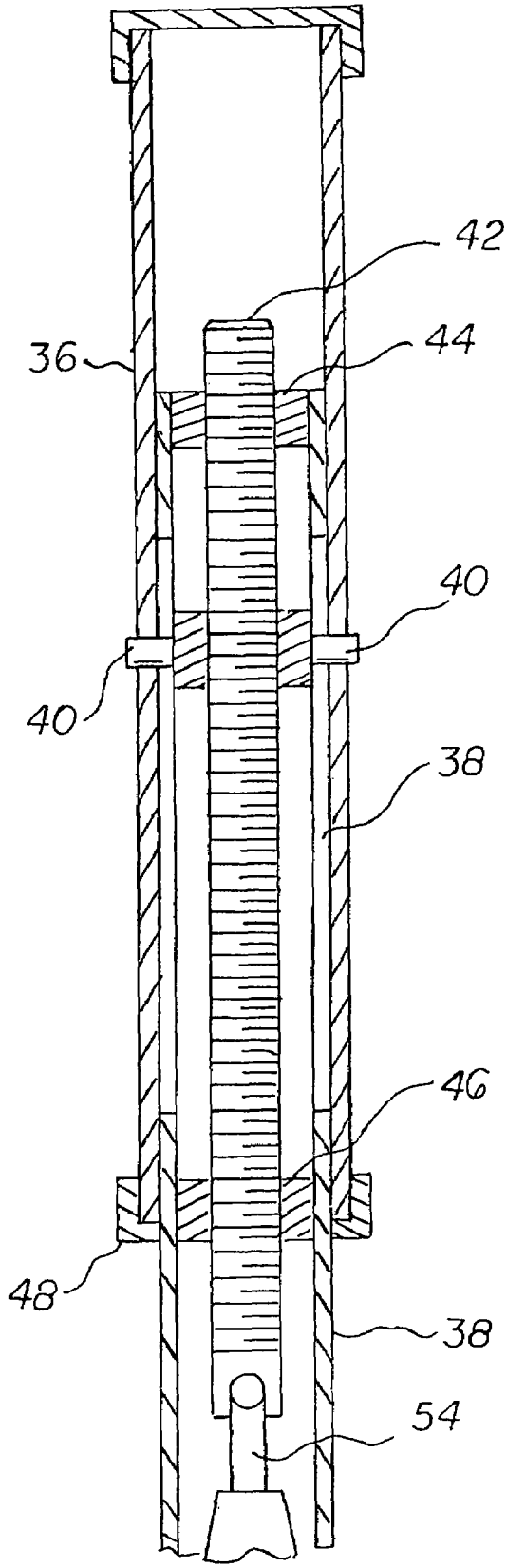
FIG. 5 is a cross sectional view taken along line 5-5 of FIG. 4.

With reference now to the drawings, and in particular to FIG. 1 thereof, the preferred embodiment of the new and improved lift chair system embodying the principles and concepts of the present invention and generally designated by the reference numeral 10 will be described.

The present invention, the lift chair system 10 is comprised of a plurality of components. Such components in their broadest context include a chair and a horizontal upper brace. Such components are individually configured and correlated with respect to each other so as to attain the desired objective.

First provided is a chair 12. The chair has an essentially horizontal seat 14. The seat has a front edge 16. The seat has a rear edge 18. The chair also has an essentially vertical back 20. The back has an upper edge 22. The back has a lower edge 24. The lower edge of the back is coupled to the rear edge of the seat. The seat has a horizontal upper surface 26. The upper surface receives a user. The seat also has a horizontal lower surface 28.

A horizontal upper brace 30 is provided. The upper brace has parallel longitudinally spaced support rails. The upper brace has parallel laterally spaced side rails. The upper brace has an upper surface. The upper surface of the upper brace receives the lower surface of the seat.

Provided next is a horizontal lower brace 32. The lower brace has parallel longitudinally spaced support rails. The lower brace has parallel laterally spaced side rails. The lower brace has a lower surface. The lower surface of the lower brace is positionable on a horizontal recipient surface.

An adjustable positioning assembly is provided. The positioning assembly is adapted to vary the height between the upper and lower braces. In this manner the height may be varied between the chair and a recipient surface. The positioning assembly includes a lower tube 34. The lower tube has an upper end. The lower tube has a lower end. The lower end of the lower tube is attached to the lower brace centrally. The lower end of the lower tube has a small square cross sectional configuration. The positioning assembly also includes an upper tube 36. The upper tube has a lower end. The lower end of the upper tube is has aligned apertures. The upper tube has an upper end. The upper end of the upper tube is attached to the upper brace rearwardly. The upper end of the upper tube has large square cross sectional configuration. The upper and lower braces and the tubes form a Z-shaped configuration. The tubes are provided at an angle of about 30 degrees from the vertical. The upper end of the lower tube is slidably received in the lower end of the upper tube. The positioning assembly includes aligned axial slots 38. The slots are provided in the lower tube. The positioning assembly includes aligned radial fingers 40. The radial fingers are provided interior of the upper tube. The radial fingers extend through the slots and aligned apertures, the radial fingers are located adjacent to the axial center of the upper tube. In this manner the lower portion of the upper tube will hide the slots when the chair and upper tube are in the upper orientation. Further in this manner the upper portion of the tube will hide the slots when the chair and upper tube are in the lower orientation.

Provided next is a drive assembly. The drive assembly raises and lowers the upper tube, upper brace and chair with respect to the lower tube, lower brace and recipient surface. The drive assembly includes a rotatable drive screw 42. The rotatable drive screw is provided interior of the tubes. The drive assembly has an upper bolt 44. The upper bolt is secured interior of the lower tube adjacent to its upper end. The drive assembly has a lower bolt 46. The interior of the lower tube supports the fingers. The upper and lower bolts are threadedly received in the drive screw. In this manner rotation of the drive screw will raise and lower the bolts, fingers, upper tube, upper brace and chair. The fingers have exterior ends. The exterior ends of the fingers have annular components 48. The annular components contact the upper tube. The annular components further limit the upward movement of the upper tube. The drive assembly also includes a motor 50. The motor has a line 52. The line couples the motor to a source of electrical potential. The motor has a driver 54. The driver couples the motor and the drive screw. The motor has a foot actuated controller 56. The foot actuated controller activates the motor and drive screw. In this manner the chair is raised and lowered.

Further provided are arm rests 58. The arm rests are secured at laterally spaced locations with respect to the chair. The arm rests have vertical supports 60. The vertical supports depend from the arm rests. The arm rests also have clamps 62. The clamps are secured at laterally spaced locations with respect to the upper brace. In this manner the vertical supports and arm rests are secured at comfortable elevations for a user. A foot rest 64 is provided. The foot rest extends forwardly from the lower tube. In this manner comfort is provided for a user.

Provided last is a table 66. The table is adjustably secured to one side of the chair. The table includes depending pivotal brackets 68. The table includes fixed brackets 70. The fixed brackets depend from one arm rest. The fixed brackets have an upper rod 72. The fixed brackets also have a parallel lower rod 74. The pivotal brackets have elongated holes 76. The elongated holes pivotally receive the upper rod. The pivotal brackets have a lower notch 78. The lower notch receives the lower rod when the table is in the operative raised orientation. Note FIG. 6. The pivotal brackets have a laterally spaced upper notch 80. The upper notch receives the lower rod when the table is in the inoperative lowered orientation. Note FIG. 7.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lift chair system comprising:

a chair including an essentially horizontal seat having a lower surface;

a horizontal upper brace supporting the chair and a lower brace with an adjustable positioning assembly between the upper and lower braces for varying the height between the chair and a recipient surface, the positioning assembly including a lower tube with an upper end and a lower end attached to the lower brace centrally, the positioning assembly also including an upper tube with a lower end and an upper end attached to the upper brace rearwardly, the upper end of the lower tube being slidably received in the lower end of the upper tube, the positioning assembly also including aligned axial slots in the lower tube and aligned radial fingers interior of the upper tube extending through the slots, the radial fingers being located adjacent to the axial center of the upper tube whereby when the chair and upper tube are in the upper orientation the lower portion of the upper tube will hide the slots and when the chair and upper tube are in the lower orientation the upper portion of the tube will hide the slots; and a drive assembly for raising and lowering the upper tube, upper brace and chair with respect to the lower tube, lower brace and recipient surface, the drive assembly including a rotatable drive screw interior of the tubes with a bolt interior of the tube, the bolt being threadedly received in the drive screw whereby rotation of the drive screw will raise and lower the bolt and chair, the drive assembly also including a motor with a line for coupling to a source of electrical potential and a driver coupling the motor and the drive screw and a controller for activating the motor and drive screw to raise and lower the chair.

2. A lift chair system comprising:

a chair including an essentially horizontal seat having a lower surface;

a horizontal upper brace supporting the chair and a lower brace with an adjustable positioning assembly between the upper and lower braces for varying the height between the chair and a recipient surface; and a table adjustably secured to one side of the chair, the table including depending pivotal brackets and fixed brackets, the fixed brackets having an upper rod and a parallel lower rod, the pivotal brackets having elongated holes for pivotally receiving the upper rod with a lower notch for receiving the lower rod when the table is in the operative raised orientation and a laterally spaced upper notch for receiving the lower rod when the table is in the inoperative lowered orientation.

3. A lift chair system for the raising and lowering of a chair in a safe, convenient and economical manner comprising, in combination:

a chair including an essentially horizontal seat having a front edge and a rear edge, the chair also including an essentially vertical back having an upper edge and a lower edge coupled to the rear edge of the seat, the seat having a horizontal upper surface for the receipt of a user and a horizontal lower surface;

a horizontal upper brace with parallel longitudinally spaced support rails and with parallel laterally spaced side rails, the upper brace having an upper surface receiving the lower surface of the seat;

a horizontal lower brace with parallel longitudinally spaced support rails and with parallel laterally spaced side rails, the lower brace having a lower surface positionable on a horizontal recipient surface;

an adjustable positioning assembly adapted to vary the height between the upper and lower braces for varying the height between the chair and a recipient surface, the positioning assembly including a lower tube with an upper end and a lower end attached to the lower brace centrally with a small square cross sectional configuration, the positioning assembly including an upper tube with a lower end formed with aligned apertures and an upper end attached to the upper brace rearwardly with a large square cross sectional configuration, the upper and lower braces and the tubes forming a Z-shaped configuration with the tubes at an angle of about 30 degrees from the vertical, the upper end of the lower tube being slidably received in the lower end of the upper tube, the positioning assembly including aligned axial slots in the lower tube and aligned radial fingers interior of the upper tube extending through the slots and aligned apertures, the radial fingers being located adjacent to the axial center of the upper tube whereby when the chair and upper tube are in the upper orientation the lower portion of the upper tube will hide the slots and when the chair and upper tube are in the lower orientation the upper portion of the tube will hide the slots;

a drive assembly for raising and lowering the upper tube, upper brace and chair with respect to the lower tube, lower brace and recipient surface, the drive assembly including a rotatable drive screw interior of the tubes with an upper bolt secured interior of the lower tube adjacent to its upper end and a lower bolt interior of the lower tube supporting the fingers, the upper and lower bolts being threadedly received in the drive screw whereby rotation of the drive screw will raise and lower the bolts, fingers, upper tube, upper brace and chair, the fingers having exterior ends with annular components to contact the upper tube and limit the upward movement of the upper tube, the drive assembly also including a motor with a line for coupling to a source of electrical potential and a driver coupling the motor and the drive screw and a foot actuated controller for activating the motor and drive screw to raise and lower the chair;

arm rests secured at laterally spaced locations with respect to the chair and having vertical supports depending from the arm rests and also having clamps secured at laterally spaced locations with respect to the upper brace to secure the vertical supports and arm rests at comfortable elevations for a user, a foot rest extending forwardly from the lower tube for the comfort of a user; and a table adjustably secured to one side of the chair, the table including depending pivotal brackets and fixed brackets depending from one arm rest, the fixed brackets having an upper rod and a parallel lower rod, the pivotal brackets having elongated holes for pivotally receiving the upper rod with a lower notch for receiving the lower rod when the table is in the operative raised orientation and a laterally spaced upper notch for receiving the lower rod when the table is in the inoperative lowered orientation.

* * * * *